US007049267B2

(12) United States Patent
Wagner et al.

(10) Patent No.: US 7,049,267 B2
(45) Date of Patent: May 23, 2006

(54) HEAT-SENSITIVE RECORDING SHEET AND THE USE THEREOF

(75) Inventors: Wolfgang Wagner, Flensburg (DE); Bernd Gerecht, Osnabrück (DE); Matthias Marx, Nortorf (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 108 days.

(21) Appl. No.: 10/472,129

(22) PCT Filed: Jan. 4, 2002

(86) PCT No.: PCT/EP02/00023

§ 371 (c)(1),
(2), (4) Date: Sep. 15, 2003

(87) PCT Pub. No.: WO02/074550

PCT Pub. Date: Sep. 26, 2002

(65) Prior Publication Data

US 2004/0092397 A1 May 13, 2004

(30) Foreign Application Priority Data

Mar. 16, 2001 (DE) ..... 101 13 286

(51) Int. Cl.
*B41M 5/40* (2006.01)

(52) U.S. Cl. ..... 503/200; 503/226

(58) Field of Classification Search ..... 503/200, 503/206, 226

See application file for complete search history.

(56) References Cited

U.S. PATENT DOCUMENTS 6,440,898 B1 8/2002 Kranz

FOREIGN PATENT DOCUMENTS

| | | |
|---|---|---|
| DE | 93 02 105.4 | 5/1993 |
| DE | 198 38 893 A1 | 3/2000 |
| DE | 198 38 895 A1 | 3/2000 |
| EP | 0 156 618 A2 | 10/1985 |
| EP | 0 229 645 B1 | 7/1987 |
| EP | 0 642 928 A1 | 9/1993 |
| EP | 0 844 097 A1 | 5/1998 |
| EP | 0 909 242 B1 | 4/1999 |
| JP | 6328839 | 11/1994 |
| WO | WO 93/08992 | 5/1993 |
| WO | WO 97/18091 | 5/1997 |
| WO | WO 01/09435 | 7/2000 |

*Primary Examiner*—B. Hamilton Hess
(74) *Attorney, Agent, or Firm*—Cohen, Pontani, Lieberman & Pavane

(57) ABSTRACT

A heat-sensitive recording sheet is formed as a laminate and includes at least a first and a second web material. The first web material has a substrate of paper with a watermark and the second web material has at least a substrate and a heat-sensitive recording layer.

13 Claims, 1 Drawing Sheet

8

8'

HEAT-SENSITIVE RECORDING SHEET AND THE USE THEREOF

PRIORITY CLAIM

This is a U.S. national stage of application No. PCT/EP02/00023, filed on 04 Jan. 2002. Priority is claimed on that application and on the following application(s): Country: Germany, Application No.: 101 13 286.7, Filed: 16 Mar. 2001.

BACKGROUND OF THE INVENTION

1. Field of the Invention

The invention relates to a heat-sensitive recording sheet with an authentic or impressed watermark and a heat-sensitive recording layer containing color formers and color acceptors, and the use thereof as a ticket.

2. Description of the Prior Art

Heat-sensitive recording sheets with authenticity-verifying security features are well known, in particular for the area of higher-value applications, for example in the case of tickets, amongst other things in the form of lottery tickets and travel tickets and, for example, also in office papers. Although a large number of authenticity-verifying security features are known, true or impressed watermarks enjoy special popularity on the market, since they also impart to the product in which they are incorporated a more valuable appearance, in addition to the authenticity verification.

Heat-sensitive recording materials with non-authentic watermarks are therefore often unsuitable to satisfy the above-described market requirements completely. Such a heat-sensitive recording material is proposed, for example, in EP-A-0 844 097, according to which the recording material has, as a first security feature, a latent image printed on its rear side and produced by means of a security ink containing a fluorescent reagent. In order to form a second security feature in the form of a waterproof image on the rear side of the heat-sensitive recording material, the security ink contains a water-repellent agent.

Heat-sensitive recording materials of the type mentioned in the introduction have been known for a long time. For example, DE-U-93 02 105 proposes a web-like carrier material for a thermosensitive recording layer with a surface of high smoothness or extremely low roughness, in which at least one authentic watermark is formed in the carrier material.

In addition, WO-A-01/09435 discloses heat-sensitive recording papers with watermarks as security features, but in exactly the same way as the text acknowledged above relates to a remote prior art inasmuch as a recording paper of two paper webs laminated together, one of which has a watermark, is neither disclosed nor suggested.

EP-A-0642 928 discloses a heat-sensitive recording material which has a detection layer on its side opposite the heat-sensitive recording layer. This detection layer has only one of the reaction components required for a color-forming reaction. A desired color reaction is initiated by applying a suitable liquid, in which the second component required for the color formation is contained. Although, in the case of papers used as a substrate, watermarks are also disclosed as an additional security feature, this text also relates to a remote prior art, since any reference to the problems when using laminated paper webs with watermarks applied thereto as a substrate for the production of heat-sensitive recording papers is lacking.

The common factor in the three proposals reproduced above is the use of substrate webs having authentic watermarks, to which a heat-sensitive recording layer is applied.

In various applications, however, this results in the disadvantage of the occurrence of what are known as "shadow images" during the thermal printing process, in which the watermarks are imaged in the thermosensitive recording layer and thus disrupt the intended text image. The reason for such shadow images is, amongst other things, the density or thickness fluctuations occurring in the carrier material because of the incorporated watermarks, which have an effect in the different sensitivities over the area of the thermosensitive recording layer. A further disadvantage of the known recording materials is their restriction to materials with a relatively low mass per unit area. Paper webs with a high mass per unit area, if they are produced in accordance with this known principle, require high drying capacities in the papermaking machine or, if these are not available, can be produced only with relatively slow-running papermaking machines. However, slow-running papermaking machines are disadvantageous on economic grounds.

Following a proposal from EP-A-0156 618, a security document to be used as a credit or check card, driver's license or else as a ticket in various forms of use comprises a substrate with a pressure-sensitive image-producing coating material which may possibly be applied only partially and which is covered by a protective layer coated on or laminated on. The substrate can contain a watermark and, in order to form a security card, can be applied to a further material.

Finally, DE-C-37 69 999 discloses a process for producing two-layer security paper with inlaid security features in the form of security threads, watermarks and the like, two layers being formed on a cylinder paper machine and the security threads being laid between them, possibly with the additional application of holes or watermarks, the paper being treated, during the sheet formation or shortly thereafter, by means of air or water jets in such a way that local fiber displacement as far as the formation of holes or watermarks is achieved. The paper layers led together are then couched and dried together. Since the document does not disclose any heat-sensitive recording layers, the problems of shadow images are not addressed.

Instead of a laminate with a plurality of substrate layers, a release paper with a large number of coatings on a base substrate is the subject of JP-A-06 328 839. The proposal made there proposes that a heat-sensitive coating A for printed image development at higher temperatures, a top coating B of high opacity, a bleaching layer C and a heat-sensitive coating D for printed image development at lower temperatures be applied in that order to the base substrate. Disclosed as a security paper, this paper permits the exclusive printed image development in the coating D during a thermal printing process at low temperatures. In this case, the printing energy is not sufficient to reach the coating A and to effect the development of a printed image there. During a thermal printing process at higher temperatures, firstly the development of a printed image in the coating A is effected. The bleaching layer C likewise activated at these higher temperatures has the effect that a printed image in the coating D is suppressed. The top layer B has the effect that the printed image of the coating A does not show through the coatings C and D.

As an application for such a release paper, it is disclosed that, for example, letters to bank customers should be produced on the coating D by using the low temperature these texts can be decoded freely. Important, secret information such as account passwords are developed only on the coating A by using the higher temperature and are not reproduced on the coating D. In order to make the information available to the customer addressed, the latter has to separate the two release layers from each other, one layer comprising the base substrate with coating A, the second layer comprising the coatings B, C and D. As a further security feature, in the context of a general reference, a watermark is disclosed, which is incorporated in the base substrate. The disadvantages of possible shadow images already discussed apply to this watermark, so that no indication as to how the object on which the present invention is based is to be achieved can be gathered from this document either.

WO93/08992 A1 has already disclosed a security ticket constructed as a laminate, which is composed of a carrier sheet consisting of paper material and a heat-sensitive recording paper which is laminated onto the carrier sheet. The heat-sensitive recording paper forms the front sheet and is to have sufficient transparency in order that a security pattern or a watermark which is applied to the carrier sheet can be detected. According to a preferred embodiment, the security feature arranged on the carrier sheet is a watermark in the form of a machine-readable bar code. An item of information applied to the carrier sheet can preferably be read by machine through the transparent or semitransparent front sheet, watermarks incorporated in the carrier sheet or security codes printed on the carrier sheet counting as equally important. Obviously, therefore, the substantial teaching of WO93/08992 A1 is to use a front sheet of a transparency which not only permits information applied to the carrier sheet to be detected through the front sheet but even machine-readable bar codes to be decoded.

SUMMARY OF THE INVENTION

The novel heat-sensitive recording sheet is intended to overcome the disadvantages listed above. Thus, it is an object of the present invention to provide a heat-sensitive recording sheet with an authentic or impressed watermark in which there is no risk of shadow images occurring in the heat-sensitive recording layer and which can be produced cost-effectively, even in the case of high masses per unit area. In addition to an authentic or impressed watermark, the novel heat-sensitive recording sheet is to be able to have further security features which verify authenticity and in whose selection it is necessary to take into account as few restrictive limits as possible, for example as a result of undesired chemical reactions of the reagents making up the authenticity-verifying security features with the color-forming components of the heat-sensitive recording layer. Thought is also given to developing a heat-sensitive recording sheet with an authentic or impressed watermark in which security threads can be incorporated, so that it cannot be confused with other heat-sensitive recording materials not having these security threads. Furthermore, the novel heat-sensitive recording sheet must be extremely capable of being used as a ticket. Associated with this is the object that the novel recording sheet must be printable by means of offset processes on the side opposite the side with the heat-sensitive recording layer. In a preferred embodiment, the side with the heat-sensitive recording layer must be designed such that it can be canceled.

In this case, a heat-sensitive recording sheet has a good ability to be canceled, in the sense of the invention, if a cancelation stamp ink consisting of color-imparting pigments and not containing solvents cannot be wiped away completely from the recording sheet, either in a dry or a wet manner, after being printed on.

The contribution of the inventors is to have discovered a heat-sensitive recording sheet which satisfies these requirements, the recording sheet comprising a laminate and this laminate having at least as carrier sheet a first web material with a substrate made of paper which has a watermark and, as front sheet, comprising a second web material with a heat-sensitive recording layer,

- the watermark being formed as an authentic (2') or impressed (2) watermark,
- the substrate (1) of the carrier sheet having the watermark (2,2') on the side facing away from the front sheet,
- the front sheet comprising at least one substrate (3) and the heat-sensitive recording layer (4) containing color formers and color acceptors, and
- the recording layer (4) being formed on the side of the substrate (3) facing away from the carrier sheet.

The result was surprising to the inventors inasmuch as there was no hint in the previous art that the achievement of the object was to be looked for in a laminate.

The application of an authentic watermark, which is produced by displacing (what is known as a light watermark) or by enriching (what is known as a shadow watermark) the fibrous stock, for example by using a dandy roll in the wire section of a papermaking machine, represents a preferred embodiment of the novel heat-sensitive recording sheets in the same way as the application of a semi-authentic watermark, what is known as a Molette watermark, which is produced by embossing the still wet paper in the press section of a papermaking machine. Since an authentic watermark is even more difficult to imitate than a Molette watermark, the recording sheet according to the invention in its embodiment with an authentic watermark is recommended when quite particularly unique authentication verification is desired. In principle, both authentic and Molette watermarks should be viewed with top illumination or spot illumination and with counter illumination. If the possibility of viewing with counter illumination is to be provided, the authentic watermark is recommended on account of its somewhat clearer structures, rather than the Molette watermark, but it is necessary for the recording sheet according to the invention to be designed to be translucent, which means that a restriction of its mass per unit area to 350 g/m$^2$ and preferably to 280 g/m$^2$ is expedient. If the watermark is to be detectable primarily or only with top illumination or spot illumination, any restriction with respect to the mass per unit area of the recording sheet according to the invention is dispensed with. In this case, the Molette watermark is recommended as particularly suitable, as is the authentic watermark, the latter, if paper is used as the substrate of the first web material, with an increased mass per unit area, preferably above 100 g/m$^2$.

The substrate of the second web material can be formed for example—without being restricted thereto—from a transparent film, in particular a film based on polyester or else a multilayer polyolefin film. In this case, no limits of any kind are placed on the thickness of the film. Other materials can also be used as the substrate of the second web material. However, if viewing the watermark formed in the substrate of the first web material in transmitted light through the recording sheet according to the invention is to be possible, it is necessary for the materials used as the substrate for the second web material to have sufficient translucency.

A preferred embodiment provides for the substrate of the second web material to be formed of paper, in particular of woodfree paper with a proportion of no more than 15% by weight of pigment and preferably with a proportion of pigment in a range from 2 to 10% by weight. In order, firstly, to be able still to guarantee good redetection of the watermark in transmitted light and, secondly, to satisfy the market requirements for a ticket that is sufficiently stiff and has a good feel, the formation of a mass per unit area of the paper of the second web material in a range from 40 to 200 g/m$^2$ and in particular between 50 and 100 g/m$^2$ is preferred.

In the case of the paper used as substrate of the first web material, woodfree paper is preferred. The paper is formed as a commercially available, preferably sized and uncoated printing paper with a mass per unit area preferably in a range from 50 to 200 g/m$^2$ and, if the watermark is preferably viewed in transmitted light, in particular between 55 and 100 g/m$^2$. In contrast, if the watermark is viewed in top or spot illumination, the mass per unit area is to be chosen to be in particular above 100 g/m$^2$. On the side facing away from the second web material, it can be treated with one or more coatings or preparations.

According to the paper—and board-making handbook (1971), layer materials which are bonded together from two or more layers of paper, metal foils or plastic films are designated a laminate.

The lamination of the first web material to the second web material and, possibly, to the further material webs is performed by using an adhesive based on water or solvents, which is applied in the form of spots or preferably over the entire area. In any case, with regard to the type of lamination and the adhesives used for the purpose, which can also be designed to be pressure-sensitive, for example, there is no restriction, provided that they harmonize with the materials to be bonded. A quite particularly preferred embodiment provides for the adhesive to be provided with security features, such as colored or fluorescent fibers, metal threads, magnetic or magnetizable constituents or pigments and and/or to design this adhesive to be colored.

The thermal head triggering the color-forming reaction of the color formers with the color acceptors in the heat-sensitive recording layer has the effect of melting the wax-like constituents in the recording layer. In order to avoid these wax-like constituents adhering to the thermal head as a melt, it is preferred that an intermediate layer containing an oil-absorbing pigment or a pigment mixture be formed between the substrate of the second web material and the heat-sensitive recording layer, the pigments in this intermediate layer effecting absorption of the melt. In this case, it is particularly advantageous if the pigments of the intermediate layer have an oil absorption of at least 80 cm$^3$/100 g and, even better, of 100 cm$^3$/100 g, determined in accordance with the Japanese standard JIS K 5101. Calcined kaolin has been particularly tried and tested on account of its large absorption capacity in the voids. Since the air in the voids of the pigments of the intermediate layer represents a good thermal insulator, an intermediate layer formed in this way acts as a heat reflection layer, which means that the thermal sensitivity of the recording material, and thus the printing speed in the thermal printer, can be increased. Furthermore, such an intermediate layer can provide a positive contribution to the equalization of the substrate surface, which means that the quantity of coating color necessarily to be applied for the heat-sensitive recording layer is reduced. The formation of an intermediate layer with a mass per unit area in a range from 5 to 20 g/m$^2$ and, even better, between 7 and 10 g/m$^2$ acts particularly advantageously.

The novel heat-sensitive recording sheet, in a preferred embodiment, has a protective layer covering the recording layer of the second web material. Protective layers, such as are used in the sense of the invention, have the effect of increasing the resistance of the heat-sensitive recording layer with respect to environmental influences such as water, plasticizers which, for example, are used in the sleeves used to hold travel tickets, oils and fats. Furthermore, it is particularly advantageous if the protective layer covering the recording layer is distinguished by good printability.

Suitable for the formation of such a protective layer is, for example, a coating color as proposed in EP-B-0 909 242. In this case, the protective layer combines high environmental resistance with the ability to be canceled and with excellent printability in the wet offset process. The protective layer can be produced relatively cost-effectively and can be applied in one layer.

In a further variant for setting its ability to be canceled, the recording layer of the novel heat-sensitive recording sheet is covered with a protective layer in which

- the pigment of the protective layer consists of one or more inorganic pigments and at least 80% by weight is formed by a highly purified alkali-conditioned bentonite,
- the binder of the protective layer consists of one or more water-insoluble, self-crosslinking acrylic polymers,
- the binder/pigment ratio in the protective layer lies in a range between 7:1 and 10:1 and
- the crosslinking agent/binder ratio in the protective layer is greater than 1:5 and preferably between 1:5 and 1:7.

Natural or precipitated calcium carbonate, kaolin or titanium dioxide are possible as further inorganic pigments for the protective layer.

Crosslinking agents recommended for the protective layer are, in particular, cyclic urea, methylolurea, polyamide epichlorohydrin resin, ammonium zirconium carbonate.

It is preferred to apply the protective layer with a mass per unit area in a range from 1.5 to 6 g/m$^2$ and in particular between 1.8 and 4 g/m$^2$.

In the novel heat-sensitive recording sheet, at least one further material web can be formed between the first and second web materials and, in a preferred embodiment, is a film, in particular a polyester or polyolefin film. In a further, particularly suitable variant, a colored paper web, what is known as an inlay, is formed as a further material web between the first and second web materials.

Other materials can also be used as a further material web to be formed between the first and second web materials. However, if viewing the watermark formed in the substrate of the first web material in transmitted light through the recording sheet according to the invention is to be possible, it is necessary for the materials of the further material web to be formed between the first and second web materials to have sufficient translucency.

The recording sheet according to the invention is to be provided with the different security features as required which are to be used for the purpose of unambiguous authenticity verification in addition to the authentic or impressed watermark. In this case, virtually no limits are placed on the selection of security features to be formed in/on the first web material, since no consideration has to be given to compatibility with the color-forming components of the recording layer. Without being restricted to this, the following security features are recommended:

- a water-insoluble dyestuff which is invisible to the naked eye and incorporated in the substrate, in particular an azine or anthraquinone dyestuff which, when the surface opposite the side with the second web material is wetted with an organic solvent or acid, effects a striking coloration, a dyestuff which is only slightly visible under daylight in the acid or neutral pH range, for example based on pyrene sulfonate, which is applied in a regular or irregular pattern to the entire area of the side opposite the side with the second web material and which, in contact with an alkaline substance, enters into a color reaction which leads to a persistent fluorescent color under daylight, a dyed and/or brightened chemical pulp which is introduced into the substrate and which is fluorescent under UV irradiation.

In addition, for security features which are incorporated or applied in/to the at least one further material web formed between the first and second web materials, there are virtually no limits, for the reason explained above.

Without being restricted to this, security features particularly recommended for the second web material are:

microcapsules which are incorporated in the recording layer and contain color formers which react with the color acceptors of the recording layer, forming a color, corresponding to DE-C-198 38 893, fibers incorporated in the recording layer, which have a color contrast in relation to the recording layer and/or are fluorescent, corresponding to DE-A-198 38 895.

Also recommended as a security feature is the incorporation of magnetic or magnetizable pigments in the substrate of the first and/or the second web material. In exactly the same way, such pigments can be incorporated in or applied to the at least one further material web formed between the first and second web materials.

In a further, preferred variant of the novel recording sheet, metal strips are formed between the first and second web materials as a security feature. The incorporation of a transponder between the first and second web materials is also possible. In this case, a transponder in the sense of this invention is to be understood as a chip used as a security feature with a circumferential copper wire as an antenna, which permits automatic and non-contact identification of the product bearing it.

The heat-sensitive recording sheet according to the invention is primarily conceived for used as a ticket and here, in particular, as a travel ticket. The watermark, if appropriate in conjunction with the further security features, permits an unambiguous authentication verification of the recording sheet according to the invention. If appropriate, the further security features used also permit the detection of attempted forgeries on the text images produced on the recording sheet according to the invention. By preventing shadow images of the watermark in the recording layer, undistorted image reproduction is possible, which is of the greatest importance in particular in the representation of bar codes.

The statements relating to the mass per unit area and to percent by weight made in the description and in the claims in each case relate to the "absolute dry" weight.

BRIEF DESCRIPTION OF THE DRAWINGS

In the drawings, wherein like references characters denote similar elements throughout the several views.

DETAILED DESCRIPTION OF THE PRESENTLY PREFERRED EMBODIMENTS

Figure 1:
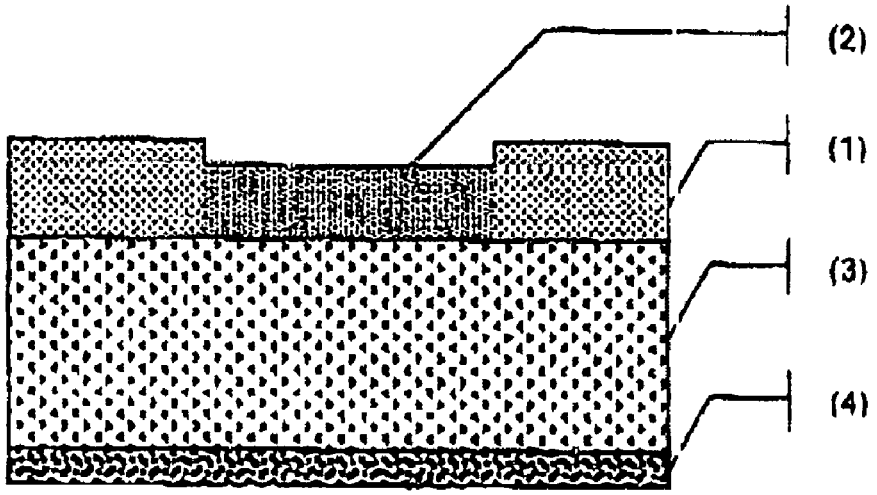
FIG. 1 is a schematic cross-sectional view of a first embodiment of a heat sensitive recording sheet according to the present invention.

The following examples illustrate the invention. The expression "ticket" used in the examples is to be understood to mean an entry card and in particular a travel ticket or travel card for the extremely wide range of public transport means.

EXAMPLE 1

A web of a woodfree paper with a mass per unit area of 90 g/m$^2$ is produced by a papermaking machine. The paper web has watermarks produced by means of a dandy roll. The second web material produced is a heat-sensitive recording paper with a mass per unit area of 82 g/m$^2$ (TQ 8067 from Mitsubishi HiTec Paper Flensburg GmbH). This heat-sensitive recording paper has an intermediate layer containing a pigment mixture and a protective layer covering the recording layer.

The two paper webs are laminated to produce a recording sheet according to the invention by using a colorless adhesive.

Firstly, in this case the side of the heat-sensitive recording paper which is to be laminated together with the first paper web is opposite the side of the heat-sensitive recording paper to which the recording layer is applied.

Secondly, in this case the side of the first paper web which is to be laminated together with the heat-sensitive recording paper is opposite the side of the first paper web which bears the watermark.

Since the protective layer of the heat-sensitive recording paper has a high absorbency to stamp ink and liquid ink, the recording sheet produced is particularly suitable for the production of tickets which can be canceled by these liquids.

EXAMPLE 2

In a manner corresponding to example 1, a recording sheet envisaged for use as a ticket is produced, with the difference that, instead of the heat-sensitive recording paper used in example 1, a heat-sensitive recording paper without a protective layer, of the grade T 7033 from Mitsubishi HiTec Paper Flensburg GmbH, with a mass per unit area of 72 g/m$^2$ is used.

EXAMPLE 3

In a manner corresponding to example 1, a recording sheet envisaged for use as a ticket is produced. Instead of the heat-sensitive recording paper used in example 1, however, a heat-sensitive recording paper with a mass per unit area of 82 g/m$^2$ (TG 8065 from Mitsubishi HiTec Paper Flensburg GmbH) is used. The protective layer of this heat-sensitive recording paper is produced in accordance with the variant specified in the present description of the protective layer disclosed in EP-B-0 909 242.

EXAMPLES 4–6

In a manner corresponding to examples 1–3, recording sheets envisaged for use as a ticket are produced and, in addition, in each case a dyed paper web with a mass per unit area of 40 g/m$^2$ is introduced between the paper web having the watermark and the web of the heat-sensitive recording paper.

EXAMPLES 7–9

In a manner corresponding to examples 1–3, recording sheets envisaged for use as a ticket are produced but, by using a dyed adhesive, a colored adhesive layer is formed between the paper web having the watermark and the web of the heat-sensitive recording paper.

EXAMPLES 10–12

In a manner corresponding to examples 1–3, recording sheets are produced but, as a further security feature, colored fibers are introduced into the layer formed by the adhesive.

EXAMPLES 13–15

In a manner corresponding to examples 1–3, recording sheets are produced but, as a further security feature, metal threads are introduced into the layer formed by the adhesive.

EXAMPLES 16–18

In a manner corresponding to examples 1–3, recording sheets are produced but, as a further security feature, magnetizable particles are introduced into the layer formed by the adhesive.

EXAMPLES 19–21

In a manner corresponding to examples 4–6, recording sheets envisaged for use as a ticket are produced but, in addition, in each case a tear-resistant film of polyester terephthalate with a mass per unit area of 15 g/m$^2$ is inserted between the paper web having the watermark and the web of the heat-sensitive recording paper.

EXAMPLE 22

In a manner corresponding to example 1, a recording sheet envisaged for use as a ticket is produced. However, instead of the heat-sensitive recording paper used in example 1, a heat-sensitive recording paper with a mass per unit area of 50 g/m$^2$ (PG 5065 from Mitsubishi HiTec Paper Flensburg GmbH) is used. This heat-sensitive recording paper has an intermediate layer containing a pigment mixture and a modified protective layer covering the recording layer. The protective layer of this heat-sensitive recording paper is formed in accordance with the variant specified in the present description of the protective layer disclosed in EP-B-0 909 242.

EXAMPLE 23

In a manner corresponding to example 1, a recording sheet envisaged for use as a ticket is produced. However, instead of the heat-sensitive recording paper used in example 1, a heat-sensitive recording paper with a mass per unit area of 120 g/m$^2$ (TG 1265 from Mitsubishi HiTec Paper Flensburg GmbH) is used. This heat-sensitive recording paper has an intermediate layer containing a pigment mixture and a modified protective layer covering the recording layer. The protective layer of this heat-sensitive recording paper is formed in accordance with the variant specified in the present description of the protective layer disclosed in EP-B-0 909 242.

The recording sheets described in examples 1–23 do not exhibit any shadow images after being labeled by means of a thermal printer. All the watermarks can easily be detected both under top illumination and in transmitted light.

The invention will be described further below with reference to the two FIGS. 1 and 2.

FIG. 1 shows the schematic structure of a first variant of the heat-sensitive recording sheet (8) according to the invention in cross section. The substrate (1) of the first web material has a Molette watermark (2) on the web material consisting of the substrate (3) and recording layer (4). The substrate (1) of the first web material is compacted in the region underneath the impressed Molette watermark (2).

Figure 2:
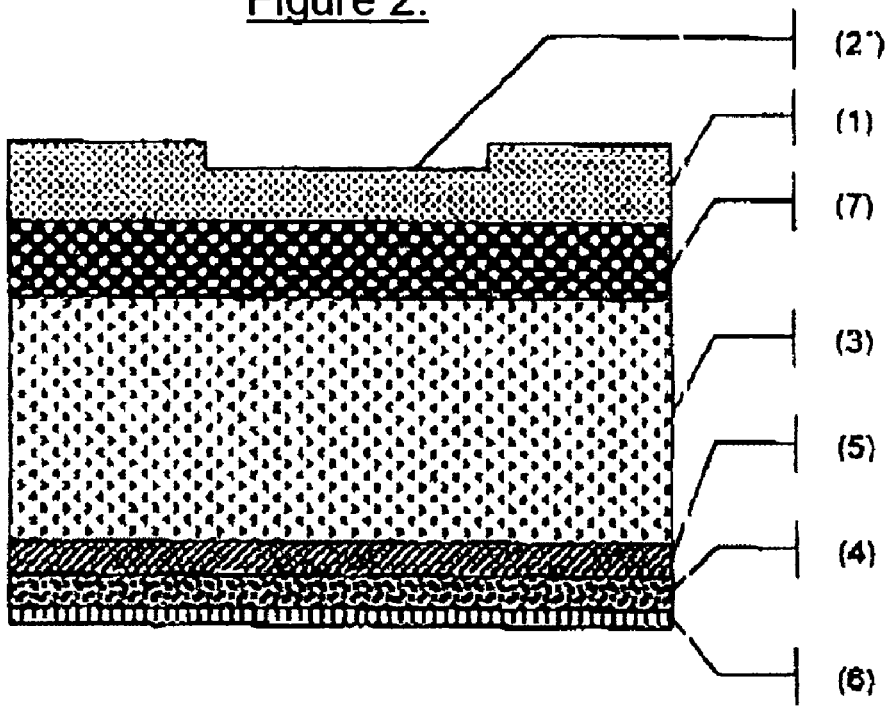
FIG. 2 is a schematic cross-sectional view of a second embodiment of a heat sensitive recording sheet according to the present invention.

FIG. 2 shows the schematic structure of a second variant of the heat-sensitive recording sheet (8') according to the invention in cross section. Here, the first web material consists of the substrate (1) with an authentic watermark (2'). The second web material comprises, in this order, as viewed from the first web material outward, the substrate (3), intermediate layer (5), recording layer (4) and protective layer (6). In addition, a further material web (7) is illustrated between the substrate (1) of the first web material and the substrate (3) of the second web material.

What is claimed is:

1. A heat-sensitive recording sheet comprising a laminate, wherein said laminate includes:

a first web material forming a carrier sheet and having a first substrate made of paper which has a watermark; and a second web material arranged on said first web material and forming a front sheet, said second web material having a second substrate and a heat-sensitive recording layer including color formers and color acceptors, said recording layer being arranged on a side of said second substrate facing away from said carrier sheet and said watermark being formed on a side of said first substrate facing away from said front sheet, and said watermark comprising one of an authentic and an impressed watermark, wherein said second web material further comprises an intermediate material between said second substrate and said heat-sensitive recording layer, said intermediate material comprising at least one pigment.

2. The heat-sensitive recording sheet of claim 1, wherein said watermark comprises an authentic watermark.

3. The heat-sensitive recording sheet of claim 1, wherein said watermark comprises a Molette watermark.

4. The heat-sensitive recording sheet of claim 1 wherein said second substrate is paper.

5. The heat-sensitive recording sheet of claim 1, wherein said second web material further comprises a protective layer covering said heat-sensitive recording layer.

6. The heat-sensitive recording sheet of claim 1, wherein at least one of said first and second web materials comprises a security feature.

7. The heat-sensitive recording sheet of claim 1, wherein said heat sensitive recording sheet comprises a ticket.

8. A heat-sensitive recording sheet comprising a laminate, wherein said laminate includes:

a first web material forming a carrier sheet and having a first substrate made of paper which has a watermark;

a second web material arranged on said first web material and forming a front sheet, said second web material having a second substrate and a heat-sensitive recording layer including color formers and color acceptors, said recording layer being arranged on a side of said second substrate facing away from said carrier sheet and said watermark being formed on a side of said first substrate facing away from said front sheet, and said watermark comprising one of an authentic and an impressed watermark; and at least one further web material formed between said first and second web materials.

9. The heat-sensitive recording sheet of claim 8, wherein said at least one further web material comprises one of foil and film.

10. The heat-sensitive recording sheet of claim 8, wherein said at least one further web material comprises a dyed paper web.

11. The heat-sensitive recording sheet of claim 8, wherein said at least one further web material comprises a security feature.

12. A heat-sensitive recording sheet comprising a laminate, wherein said laminate includes:

a first web material forming a carrier sheet and having a first substrate made of paper which has a watermark;

a second web material arranged on said first web material and forming a front sheet, said second web material having a second substrate and a heat-sensitive recording layer including color formers and color acceptors, said recording layer being arranged on a side of said second substrate facing away from said carrier sheet and said watermark being formed on a side of said first substrate facing away from said front sheet, and said watermark comprising one of an authentic and an impressed watermark; and metal strips incorporated between said first and second web materials.

13. A heat-sensitive recording sheet comprising a laminate, wherein said laminate includes:

a first web material forming a carrier sheet and having a first substrate made of paper which has a watermark;

a second web material arranged on said first web material and forming a front sheet, said second web material having a second substrate and a heat-sensitive recording layer including color formers and color acceptors, said recording layer being arranged on a side of said second substrate facing away from said carrier sheet and said watermark being formed on a side of said first substrate facing away from said front sheet, and said watermark comprising one of an authentic and an impressed watermark; and a transponder incorporated between said first and second web materials.

* * * * *